United States Patent [19]

Reiher

[11] 4,028,045

[45] June 7, 1977

[54] SPECIALIZED CANDLE

[76] Inventor: Wilfred L. Reiher, 4701 N. 55th St., Phoenix, Ariz. 85018

[22] Filed: Apr. 4, 1975

[21] Appl. No.: 565,270

[52] U.S. Cl. ..... 431/289; 21/111

[51] Int. Cl.[2] ..... F23D 3/16

[58] Field of Search ..... 431/288, 289, 291, 126; 21/108, 111

[56] References Cited

UNITED STATES PATENTS

| | | | |
|---|---|---|---|
| 345,272 | 7/1886 | Brown | 431/288 |
| 1,726,304 | 8/1929 | Lewis | 431/288 |
| 2,229,131 | 1/1941 | Root | 431/288 |
| 2,310,019 | 2/1943 | Hamblet | 431/288 |
| 3,283,546 | 11/1966 | Matsui | 431/288 |
| 3,898,039 | 8/1975 | Lin | 431/288 |

FOREIGN PATENTS OR APPLICATIONS

| | | | |
|---|---|---|---|
| 5,902 | 1897 | United Kingdom | 431/288 |

*Primary Examiner*—Carroll B. Dority, Jr.
*Attorney, Agent, or Firm*—Herbert E. Haynes, Jr.

[57] ABSTRACT

A candle having a columnar body therein of a mixture of wax and a specializing additive, and method of making same including the steps of: forming an elongated cavity within the body of a candle; combining wax with a specializing additive to form a homogeneous mixture thereof; and inserting the mixture into the elongated cavity formed in the candle body.

4 Claims, 10 Drawing Figures

SPECIALIZED CANDLE

BACKGROUND OF THE INVENTION

1. Field of the Invention

This invention relates to candles and more particularly to a specialized candle and method of making same.

2. Description of the Prior Art

For many years special materials have been mixed with molten wax to produce a homogeneous mixture which is molded, or otherwise formed, in accordance with techniques well known in the art, to produce candles having special characteristics. Such specializing materials include a wide variety of scent producing compounds, insect repellents, deodorizing chemicals, and the like. Although these specialized candles are commercially very successful, there are several problems associated therewith from the standpoints of manufacturing, usage, and a compromised product.

In the first place, specializing additives, such as those mentioned above, act as impurities when added to candle wax and those impurities cause the undesirable results of softening of the finished candle body and a lowering of the melting point.

Softening of the candle body is undesirable in that more than the usual amount of care must be exercised in the packaging, shipping, and other handling of the finished product to prevent disfiguring thereof.

Lowering of the melting point of the candle is also undesirable in that excessive melting of the wax occurs during burning of the candle and the molten wax will oftentimes drip down the sides of the candle. Along with being messy, a dripping candle is inefficient in that the molten wax thus lost is a waste of the combustible material of the candle. A further problem associated with candles having a low melting point is that oftentimes special refrigeration equipment is needed for storage and/or shipment to insure that relatively high ambient temperatures do not cause the candle body to sag or become otherwise deformed.

These problems of softening and lower melting point can be controlled somewhat to within acceptable levels by either employing a harder candle wax having a higher melting point than would otherwise be needed, or by carefully controlling the amount of specializing additive that is mixed into the candle wax. The use of a harder and higher temperature wax, although allowing the use of somewhat larger quantities of specializing additives, is still subject to the limited use of such additives, and the wax itself results in a considerable rise in the cost of manufacturing such candles as this type of wax is relatively more expensive. Therefore, the most often used method of controlling these problems is to simply limit the amount of specializing additives employed to a point where the finished candle body will not be excessively soft or have an excessively low melting point.

It may now be seen that the prior art method of mixing limited amounts of specializing additives with the molten wax results in a compromised product in that such limiting oftentimes does not allow the use of sufficient quantities of the specializing additive to adequately achieve the desired result.

A further drawback in the above described prior art technique of homogeneously mixing specializing additives with the candle wax is that the effectiveness of the additives is continuously being diminished by the dissipation thereof into the air from the large exposed surface areas of the candle body.

From the manufacturing standpoint, the prior art technique of making specialized candles is undesirable in that each type of specialized candle is different, and expeditious filling of orders requires that inventories of each type of candle be maintained at all times. Such a requirement can be very costly to the manufacturers due to the needed storage facilities and the capital investment which is tied up in inventories which may or may not move rapidly.

In view of the above, a need exists for a new and improved specialized candle and method of making same which overcomes some of the problems and drawbacks of the prior art.

SUMMARY OF THE INVENTION

In accordance with the invention, a new and improved candle structure is disclosed as having a columnar body therein which is a mixture of candle wax and at least one specializing additive, such as one or more of the varieties of scent producing compounds, insect repellents, deodorizing chemicals, and the like. By containing the specializing additive within the candle wax of the columnar body rather than mixing thereof homogeneously within the main portion of the candle wax itself, the finished candle retains the inherent hardness and melting point of the candle wax. A candle made in accordance with the present invention further solves some of the problems of the prior art by allowing substantially larger quantities of the specializing additive to be employed with little or no dissipation thereof into the ambient air. From a manufacturing standpoint, greater versatility can be achieved in that an inventory of nonspecialized candles can be maintained as needed, and those nonspecialized candles can be specialized in accordance with received orders by simply inserting the desired columnar bodies into the otherwise prepared candles.

In addition to the above described specialized candle, the method of making that candle is also disclosed as including the steps of: forming an elongated cavity within the body of a candle, combining candle wax and at least one specializing additive to form a mixture thereof, and inserting that mixture into the elongated cavity of the candle body.

Accordingly, it is an object of the present invention to provide a new and useful specialized candle.

Another object of the present invention is to provide a new and useful specialized candle in which a mixture of candle wax and at least one specializing additive is contained within a cavity formed in the candle body.

Another object of the present invention is to provide a new and useful specialized candle of the above described character and method of making same.

The foregoing and other objects of the present invention as well as the invention itself may be more fully understood from the following description when read in conjunction with the accompanying drawings.

DESCRIPTION OF THE PREFERRED EMBODIMENT

Figure 1:
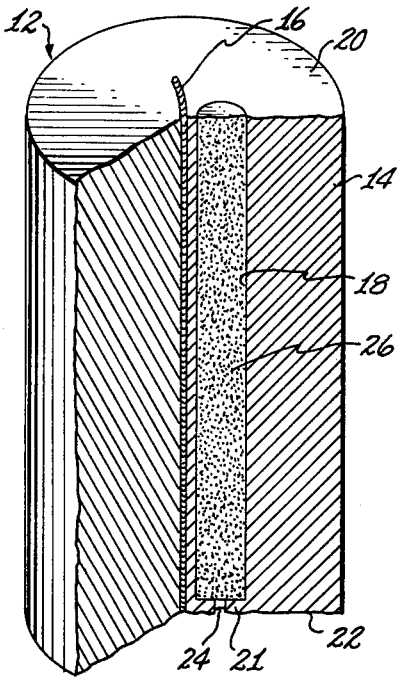
FIG. 1 is an isometric view of the specialized candle of the present invention partially broken away to show the various features thereof.

Referring more particularly to the drawings, FIG. 1 illustrates a specialized candle of the present invention which is indicated generally by the reference numeral 12. The candle 12 includes a conventional cylindrical candle body 14 which is shown in that particular shape for illustrative purposes only as the shape of the candle body plays no part in the present invention. As is customary, the candle 12 also includes the usual elongated candle wick 16 which is coaxial with the candle body 14.

In accordance with the present invention, the candle 12 is provided with an elongated cavity 18 therein which extends axially of the candle body 14 substantially parallel with and adjacent the candlewick 16. The axially disposed cavity 18 is open at the top thereof and extends downwardly from the top 20 of the candle body 14. It is preferred that the cavity 18 in the candle body 14 be closed at the bottom 21 thereof adjacent the base 22 of the candle body 14 with the exception that a relatively small vent hole 24 is formed through the closed bottom 21 as will hereinafter be described in detail.

The cavity 18 is formed and disposed as described above to contain a columnar body 26 therein. The columnar body 26 is a homogeneous mixture of candle wax and at least one specializing agent or additive.

The candle wax employed in the mixture which forms the columnar body 26 may be any of the commonly used types of candle wax and the specializing agent may be in the form of one or more of the commonly used scent producing compounds, insect repellents, deodorizing chemicals, and the like. As to the mix ratio, it has been determined that ratios of about 50–50 may be satisfactorily employed. It should be understood that more than 50% of the specializing agent may be employed if desired. This, of course, is dependent upon the particular specializing agent employed and the degree of softness than can be tolerated in the columnar body. If excessive amounts of specializing agents are used in forming the body 26, the results will be an excessively softened mass which could possibly be poured out of the open top of the axial cavity 18.

Figure 2:
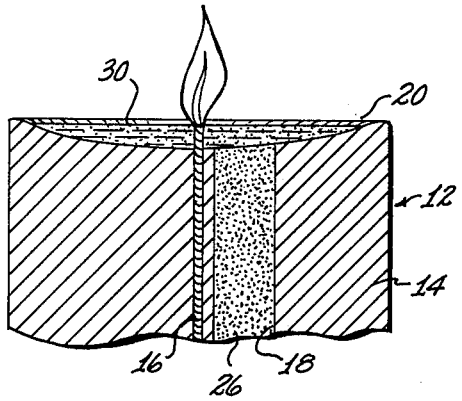
FIG. 2 is an enlarged fragmentary sectional view of the candle of the present invention showing burning thereof.
Figure 3:
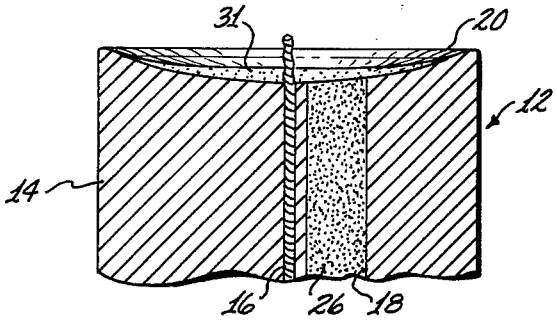
FIG. 3 is a view similar to FIG. 2 which illustrates the candle of the present invention after its having been extinguished.

Reference is now made in FIGS. 2 and 3 which will now be employed to describe the characteristics of the specialized candle 12. As is well known in the art, when a candle is lit, the heat from the flame melts the candle wax adjacent to that flame and forms a pool of molten wax as shown at 30 in FIG. 2. The molten wax of course, serves as fuel for the burning process, and this melting of the candle wax will also include melting of the wax in the columnar body 26. Melting of the candle wax in the columnar body 26 will liberate the specializing additive contained therein and dispersion thereof will take place due to normal atmospheric air currents and air currents which rise as a result of the heat produced by burning of the candle 12.

When the flame of the candle 12 is extinguished as shown in FIG. 3, the molten wax pool 30 will solidify as shown at 31 and provide a protective shield or cover over the columnar body 26 which reduces dissipation of the specializing agent to a minimum. In fact, the only dissipation of the specializing agent will be from the exposed surface of the solidified pool 31, and that dissipation will continue only for a relatively short time.

From the foregoing, it should now be apparent that by mixing the specializing agent with candle wax and containing that mixture within the columnar body 26, the purity of the wax of the candle body 14 will not be affected thus, no softening or lowering of the melting point will occur. Further, it should also be apparent that when compared to the prior art techniques, improvements have been made in the amount of specializing additives which may be used and the controlling of dissipation of those additives.

Figure 4:
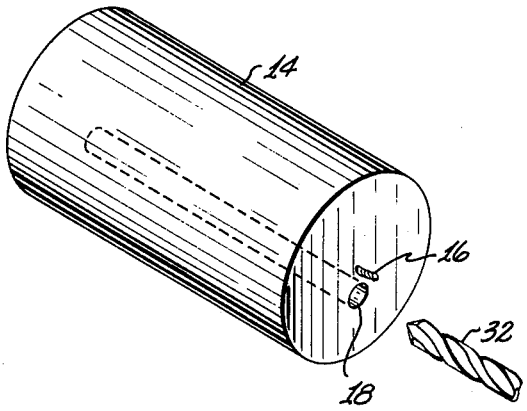
FIG. 4 is an isometric view of a candle body upon which the first step of the method of the present invention has been accomplished.
Figure 5:
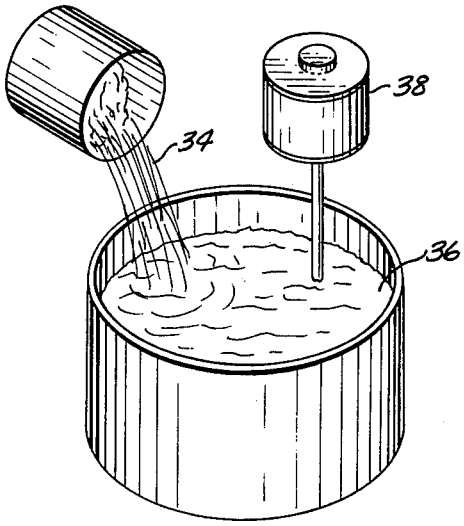
FIG. 5 is a diagramatic illustration which shows the accomplishment of the second step of the method of the present invention.
Figure 6:
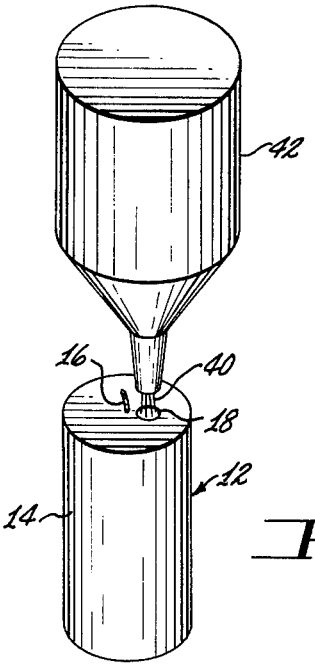
FIG. 6 is a diagramatic view illustrating another step of the method of the present invention.

Reference is now made to FIGS. 4–6 wherein the preferred method of making the above described specialized candle 12 is shown. FIG. 4 shows the cylindrical candle body 14 as having had the cavity 18 formed therein such as by drilling with a suitable drilling mechanism 32. It should be apparent that the cavity 18 could be formed simultaneously with molding of the candle body 14 if that body were formed by the conventional molding process. Thus, the first step of the present method may be described as forming an elongated cavity in a candle body with the preferred method of accomplishing this step being to drill the cavity 18 into the preformed candle body 14.

The second step in the preferred method is shown in FIG. 5 as being the combining of at least one specializing agent 34 with molten candle wax 36 to form a substantially homogeneous mixture thereof. The mixing may be accomplished in any convenient manner such as with a suitable agitator 38.

FIG. 6 illustrates the homogeneous mixture 40 of candle wax and specializing agent being inserted into the cavity 18 of the candle body 14. In accomplishing this step, the previously described vent hole 24 (FIG. 1), formed through the closed bottom 21 of the cavity 18, comes into use as the air within the cavity 18 must be allowed to escape as the mixture 40 is inserted into the cavity 18. It is preferred that the mixture 40 be in the solidified state when being inserted into the cavity 18 to minimize the messiness of such an operation and to eliminate the need for a cooling time at this stage of the operation. Thus, an additional step of cooling the combined mixture of molten wax and the specializing agent is preferrably accomplished prior to the step of inserting the mixture into the cavity. However, it should be apparent that the mixture 40 could be inserted into the cavity 18 while in the molten state, or at least within the time span that the mixture 40 retains a goodly portion of the heat. As seen in FIG. 6, a suitable injection device 42 may be employed for inserting the mixture 40 into the cavity 18, and that device 42 could take the form of a suitably operated piston mechanism (not shown) to supply the needed force to insert the mixture 40 into the cavity 18 when that mixture is in the solidified state. In this instance where the mixture 40 is to be inserted into the cavity 18 in the molten state, the device 42 may be in the form of a simple funnel (not shown).

In either event, it should now be apparent that the previously described step of inserting the mixture 40 into the cavity 18 of the candle body 14 results in the formation of the columnar body 26 within the candle body 14.

Figure 7:
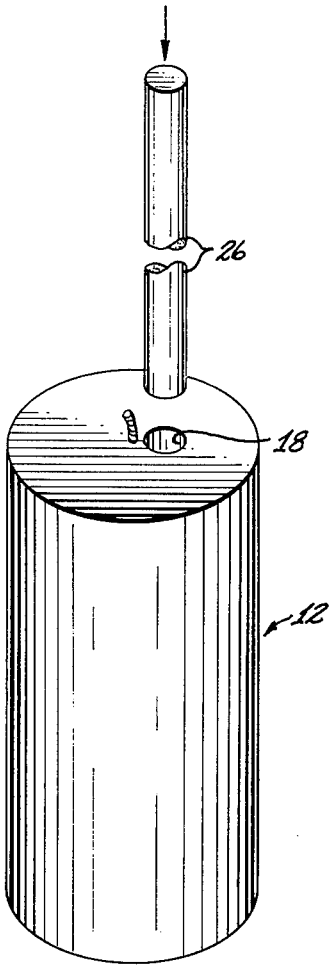
FIG. 7 is an isometric view of a variation of one of the steps of the method of the present invention.

FIG. 7 shows an alternate method of accomplishing the objective of forming the columnar body 26. In this alternate method, the mixture 40 is shaped into the columnar body 26 externally of the cavity 18 of the candle body 14 and is then inserted therein. This may be accomplished such as by molding, extruding or otherwise shaping the mixture 40 into the desired configuration of the columnar body 26, and then simply sliding the preformed columnar body into the cavity of the candle body.

Figure 8:
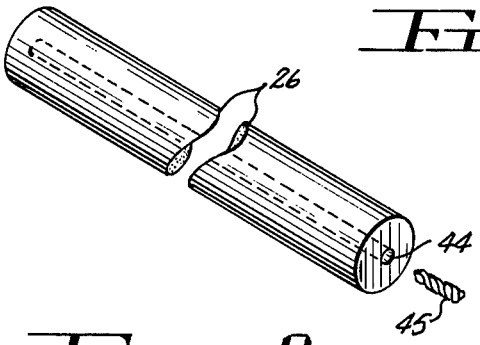
FIG. 8 is an isometric view showing a first step in a modification of the method of the present invention.
Figure 9:
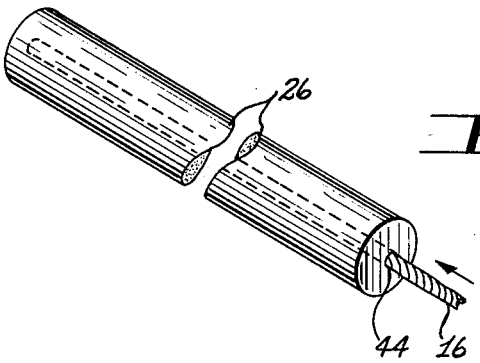
FIG. 9 is an isometric view of another step of the modified method of the present invention.
Figure 10:
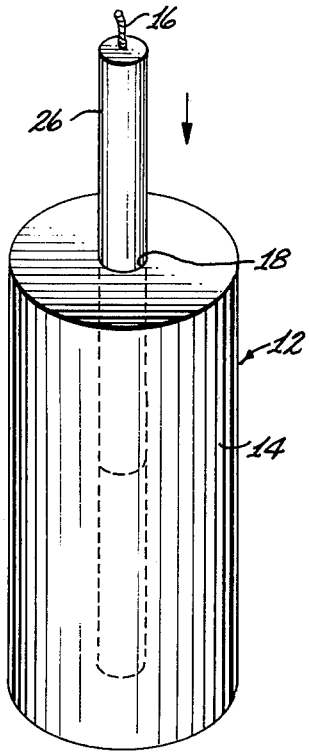
FIG. 10 is an isometric view of the last step of the modified method of the present invention.

FIGS. 8–10 show still further steps which may be accomplished in the method of the present invention. In this modified form, the preformed columnar body 26 is provided with a coaxial bore 44, such as with a suitable drill 45, and the candlewick 16 is inserted into that bore 44. The candle body 14 is provided with the hereinbefore described cavity 18 formed therein, however, in this instance, that cavity 18 is positioned coaxial with respect to the candle body 14. Thus, as shown in FIG. 10, when the columnar body 26 is inserted into the coaxial cavity 18, the candlewick 16 is simultaneously inserted therein.

Thus is should now be apparent that the columnar body 26 can be located so as to encase the candlewick 16, or may be located adjacent thereto. However, it should be noted that the preferred method is to locate the columnar body 26 adjacent the candlewick 16. The reasons for this preference is that if the columnar body 26 is coaxial with the candlewick 16, the mix-ratio of specializing agent to candle wax must be limited to insure that the columnar body is sufficiently hard enough and of a high enough melting point to maintain proper candlewick positioning. Further, such coaxial location of the columnar body 26 with respect to the candlewick 16 can cause some combustion problems in that the impurities of the specializing agents will be in direct substantially undiluted contact with the candlewick, and this can cause clogging or blockage of the candlewick with noncombustible material, and therefore hamper, or in some cases, cause complete stoppage, of the wicking action. However, it should be noted that the columnar body 26 should be located in the vicinity of the candlewick 16 so that full melting of the body 26 may be insured during burning of the candle 12. This point is particularly critical when high temperature wax is employed in making of the candle body 14.

It may not be seen that the hereinbefore described method of making the specialized candle 12 is particularly desirable from a manufacturing standpoint in that a plurality of candle bodies not containing any specializing additives can be produced, and when an order is received for a particular type of specialized candle, that order can be expeditiously filled by simply performing the hereinbefore described steps of the method of the present invention in which the mixture 40 employed contains the specifically ordered specializing agent.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A candle structure comprising:

a. an elongated candle body having a coextensive bore;

b. an elongated candlewick in said candle body and extending substantially along the longitudinal axis thereof; and c. a wickless columnar body located within said bore and laterally spaced from and substantially parallel with respect to said candlewick and coextending therewith, said columnar body formed of a mixture of candle wax and a deodorizing chemical, said columnar body located adjacent said candlewick for controlled release of the deodorizing chemical in response to the heat of the flame of said candlewick when said candlewick is lit.

2. A candle structure as claimed in claim 1 wherein said columnar body is of cylindrical configuration and extends substantially the full length of said candle body.

3. A candle structure comprising:

a. an elongated candle body having a coextensive bore b. an elongated candlewick in said candle body and extending substantially along the longitudinal axis thereof; and c. a wickless columnar body located within said bore and laterally spaced from and substantially parallel with respect to said candlewick and coextending therewith, said columnar body formed of a mixture of candle wax and at least one scent producing material, said columnar body located adjacent said candlewick for controlled release of the scent producing material in response to the heat of the flame of said candlewick when said candlewick is lit.

4. A candle structure comprising:

a. an elongated candle body having a coextensive bore b. an elongated candlewick in said candle body and extending substantially along the longitudinal axis thereof; and c. a wickless columnar body located within said bore and laterally spaced from and substantially parallel with respect to said candlewick and coextending therewith, said columnar body formed of a mixture of candle wax and an insect repellent material, said columnar body located adjacent said candlewick for controlled release of the insect repellent material in response to the heat of the flame of said candlewick when said candlewick is lit.

* * * * *